United States Patent [19]

Smyth

[11] 3,994,413

[45] Nov. 30, 1976

[54] EASY OPENING END WITH COMBINED GUARD AND OPERATIVE MEANS FOR RUPTURING SCORE

[75] Inventor: George F. Smyth, Los Angeles, Calif.

[73] Assignee: Dayton Reliable Tool & Mfg., Co., Dayton, Ohio

[22] Filed: July 7, 1975

[21] Appl. No.: 593,763

[52] U.S. Cl. ..... 220/267; 220/277; 220/268; 220/90.6; 222/83

[51] Int. Cl.[2] ..... B65D 43/02; B65D 17/00

[58] Field of Search ..... 220/277, 267, 268, 269, 220/258, 90.6; 222/541, 81, 83

[56] References Cited

UNITED STATES PATENTS

| | | | |
|---|---|---|---|
| 3,338,461 | 8/1967 | Cookson | 220/269 |
| 3,807,597 | 4/1974 | Wells et al. | 222/81 X |
| 3,877,604 | 4/1975 | Brown | 220/267 |

*Primary Examiner*—George T. Hall

[57] ABSTRACT

An end structure for an easy open container includes an end wall and a panel defined by a score line. Fold portions, which support the panel in a plane different from the end wall, form an annular shoulder around the score line. A guard ring having portions defining a manually actuatable punch is rotatable on the shoulder between a first position wherein the punch has a distal relationship with the score line and a second position wherein the punch has a proximal relationship with the score line. The guard ring can be set to the first position to inhibit opening of the container and can be moved to the second position to facilitate opening of the container. With the rupturing of the score line and displacement of the panel to open the container, the guard ring displaces slightly to guard the sharp free edge of the ruptured score line and thereby to inhibit lacerations of the user's finger.

16 Claims, 16 Drawing Figures

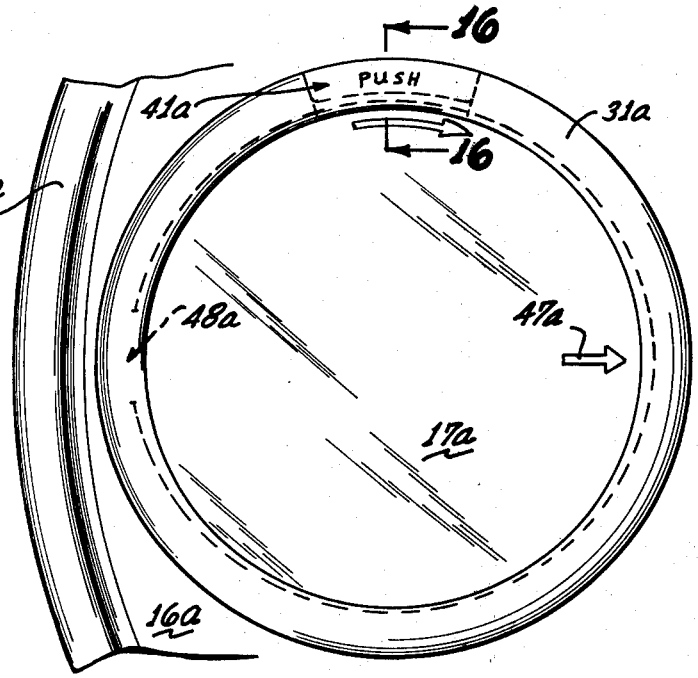
FIG. 12
FIG. 13
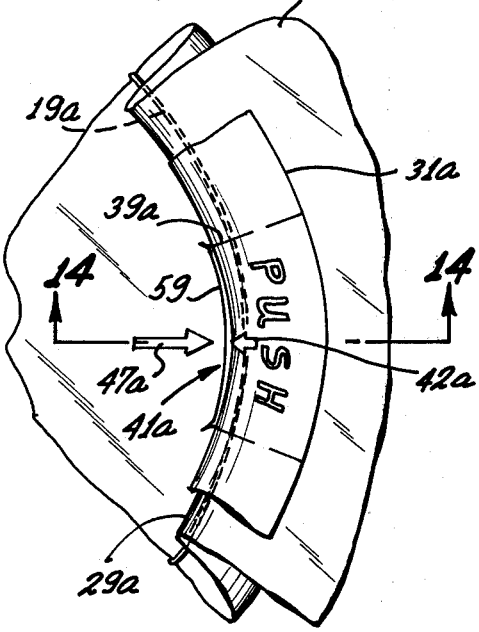
FIG. 14
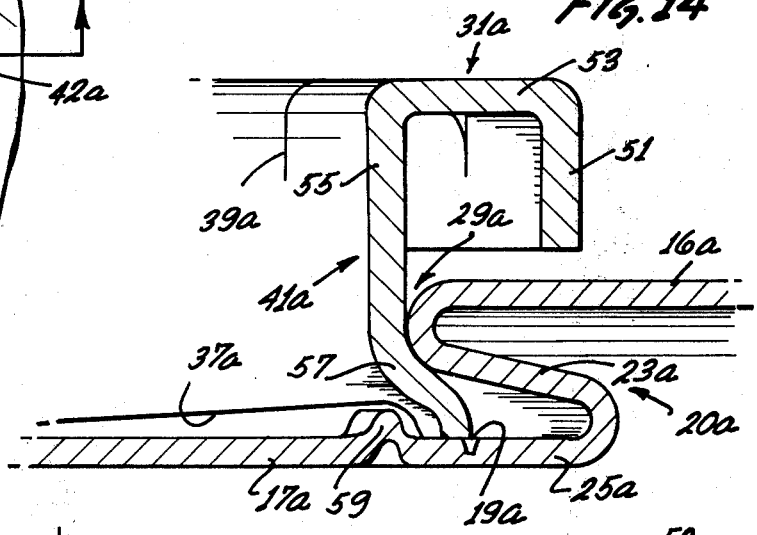
FIG. 15
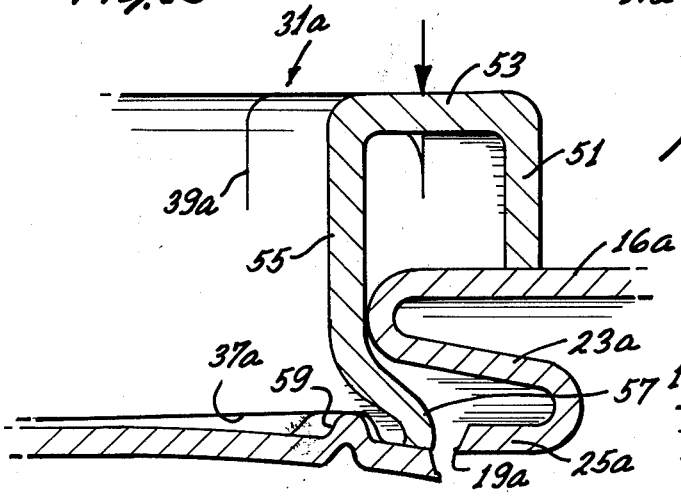
FIG. 16
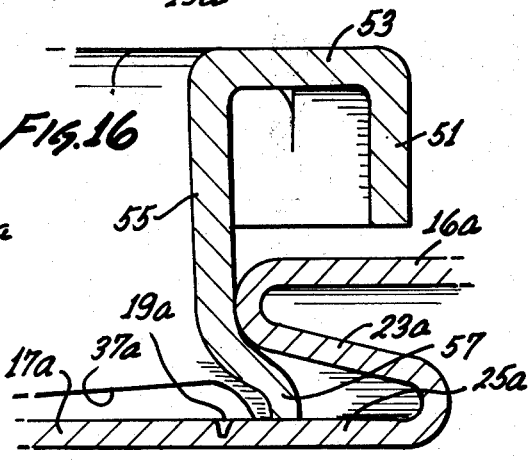

EASY OPENING END WITH COMBINED GUARD AND OPERATIVE MEANS FOR RUPTURING SCORE

BACKGROUND OF THE INVENTION

This invention relates generally to easy opening containers and more specifically to easy opening containers of the ecology type having a nondiscardable tear strip.

The ready acceptance of easy opening containers has resulted in extensive use of this type of container for a substantial number of products, especially comestible products such as beverages including beer, soft drinks, and the like. A common variety of this type of container is characterized by a lever or tab permanently joined to a tear strip, the latter being separable from the container to provide a pouring spout in the end wall of the container. With this common type of pull tab container, the tear strip and the tab have been entirely removable and discardable.

The convenience of easy opening containers has created problems due to the unfortunate and indiscriminate disposition of the severed portion of the container. For example, beach and picnic areas have had an accumulation of litter in the form of tabs and tear strips which have been removed from easy opening containers. These discarded tabs and tear strips are quite difficult to clean up because they are small and therefore pass through the tines of any raking apparatus. Being normally made of aluminum, they cannot be collected by magnetic means. Nonetheless, this type of container is widely used.

In addition to the problem of litter, the widespread use of easy opening containers has increased the incidence of laceration due to exposure of the free edge formed after the score line is ruptured and the tear strip removed.

There also have been problems associated with the accidental rupturing of the weakened area of the score line. These problems have typically occurred during shipping where several of the containers have been stacked, thereby producing significant stacking forces on the weakened areas. This problem has been further compounded by the provision of finger tabs of the type having a projection adjacent to the score line which localizes pressure on the score line when the tab is lifted. Although this type of finger tab has been desirable to facilitate opening of the container, mere stacking pressures on this type of tab have often resulted in the accidental rupturing of the score line.

Several different approaches have been used in the prior art to overcome some of the foregoing problems. By way of example, the noncontinuous score line has been used such that the tear strip remains attached to the container; see, for example, U.S. Pat. No. 3,327,891. An improvement in the structure described in the aforementioned U.S. Patent is set forth in U.S. application Ser. No. 103,255, filed Dec. 31, 1970, and assigned to the same assignee. In this application, a container end having an inseparable tear strip is described as including means to eliminate sharp edges along the score line. Another improved approach to the problem is described in U.S. Patent application Ser. No. 346,712, filed Mar. 30, 1973, and assigned to the same assignee.

Recently, container ends have been formed with what is described as a "push-button end" in that buttons are formed in the end wall. One such structure is illustrated in U.S. Pat. No. 3,334,775 in which a panel is forced downwardly into the container for providing a pour opening. In that structure, the score line is so formed that the score faces the interior of the container, i.e. the "non-public" side, so-called. The score is in turn covered by a plastisol sealant which is positioned on the underside i.e. the interior or non-public side of the container. In the usual course, the container end is fabricated and then the plastisol is applied. Not only is the application of a plastisol or other coating to a fabricated container end a relatively expensive operation, but there are other objections.

For example, in opening such a container the panel is forced into the container and the sealant bead must be ruptured. If the bead does not rupture "clean" small pieces of the sealant may separate and fall into the container. In other cases, "stringers" are formed. It is apparent that formulation of the sealant must be such as to avoid ingredients which may adversely affect the flavor of the product within the container. Also, harmful components which may be extracted from the sealant must be avoided.

Yet, when the score line is on the non-public side of the end wall, a sealant or other protective coating is used.

Another type of push-button end currently being used involves a lanced panel which forms a hinged opening panel. The lanced panel is thereafter coined such that its radial dimension is greater than that of the opening. The lanced panel is then sealed to the end wall by a bead of sealant placed on the non-public side of the end wall, and giving rise to the same objections noted above.

The normal procedure for opening a container having a push-button end involves manually forcing the button into the container by use of one's finger, as opposed to the use of an integrally attached tab to pull the button upwardly and away from the end wall, as is the case with the tear strip type of easy open containers. By forcing the button downwardly into the container, either as a separately severed element which drops into the container, or as a hinged panel which is bent toward the underside of the end wall, the problem of loose pieces which could be considered a source of litter is overcome. However, a potential hazard exists because of the free edge of the score line which results and the necessity for the user to urge the panel down into the container thus necessitating positioning of one's finger in close proximity to the free edge of the score.

Structures for end walls of containers are also known in which protective beads are formed to protect against laceration. For example, see U.S. Pat. No. 3,303,958 which describes an end wall which is removed by pulling away from the container. U.S. Pat. No. 3,696,961 describes an end in which the end wall is bent downwardly to rupture the score line and then the panel is pulled outwardly as a separate piece. Again, the use of a plastisol sealant is described.

U.S. Pat. No. 3,362,569 of 1968 describes a variant of a push button type of convenient opening. Somewhat modified in form, the type of score line there described has been used for push button ends and is referred to as a "pinched" score line.

In a U.S. Pat. Application Ser. No. 413,842 assigned to the assignee of the present application, an easy open push button ecology end is disclosed which includes protective means cooperating with a push button panel of an end wall. The protective means overlies the panel and the score line to prevent contact between the free edge of the score line and the user and to prevent the panel from being withdrawn through the formed aperture in the end wall. The portions of the end wall which are connected to the side wall of the container are disposed in a different plate than the panel of the end wall so that a shoulder is formed. This shoulder supports the annular protective means in proximity to the score line.

SUMMARY OF THE INVENTION

The present invention relates to an easy open container and particularly to a container end structure for use with cans, bottles, and the like for dispensing beverages and other comestible products. The container end structure includes a panel which forms an opening and which is not separately discardable from the container. Guard means is provided to reduce the incidence of laceration due to the relatively sharp free edge created by the ruptured score line. This container end structure also includes particular means facilitating rupture of the score line. If desired, the rupturing means may be movable between a first position wherein the rupture of the score line is inhibited and a second position wherein the rupture of the score line is facilitated. Thus the particular means can be set in the first position during transportation of the containers to inhibit rupture of the score line, and then the user can move the particular means to the second position to facilitate opening of the container.

The container may be provided with an end wall which has a first portion connected to the sidewall of the container and a second portion defining a panel in the end wall of the container. In a particular embodiment, fold means may be provided for interconnecting the first and second portions of the end wall and to define, with the panel of the end wall, a score line. This fold means may also provide an annular shoulder upon which a guard ring may be mounted.

A portion of the guard ring may define a pressure point or punch which, if desired, may be movable relative to the score line with the rotation of the ring. For example, in a particular embodiment, the ring is rotatable so that the pressure point is movable from a first position wherein the pressure point and the score line have a distal relationship and a second position wherein the pressure point and the score line have a proximal relationship. In the second position, the guard ring can be pressed downwardly in the area of the pressure point to rupture the score line and depress the panel into the container. Further movement of the user's finger against the panel will press the panel into the container. During this further movement, the guard ring maintains the user's finger away from the sharp edge of the ruptured score line to inhibit lacerations.

During the trasporting of the containers, the guard ring can be rotated to the first position wherein the pressure point and the score line have a distal relationship. In this position, mere stacking forces on the guard ring will be transmitted to a nonweakened area of the container end wall to inhibit rupture of the score line.

The score line may be located beneath the guard means to protect the weakened area of the container end from other objects which might create sufficient pressure on the end wall to rupture the score line.

It will be apparent that other advantages and modes will be readily understood by those skilled in the art after they have read the detailed description and referred to the accompanying drawings which illustrate what are presently considered to be preferred embodiments of the best mode contemplated for utilizing the novel and improved structure set forth in the appended claims.

DESCRIPTION OF THE DRAWINGS

FIG. 12 is a fragmentary top view of the container showing a further embodiment of the container end structure having a movable guard ring disposed in a nonrupturable relationship with a score line;

FIG. 13 is a fragmentary top view of the guard ring in the embodiment of FIG. 12 with the guard ring positioned in a rupturable relationship with the score line;

FIG. 14 is a fragmentary cross-sectional view taken on lines 14—14 of FIG. 13 immediately prior to the rupture of the score line;

FIG. 15 is a fragmentary cross-sectional view taken on lines 14—14 of FIG. 13 immediately following the rupture of the score line; and FIG. 16 is a fragmentary cross-sectional view taken on lines 16—16 of FIG. 12.

DESCRIPTION OF PREFERRED EMBODIMENTS

Figure 1:
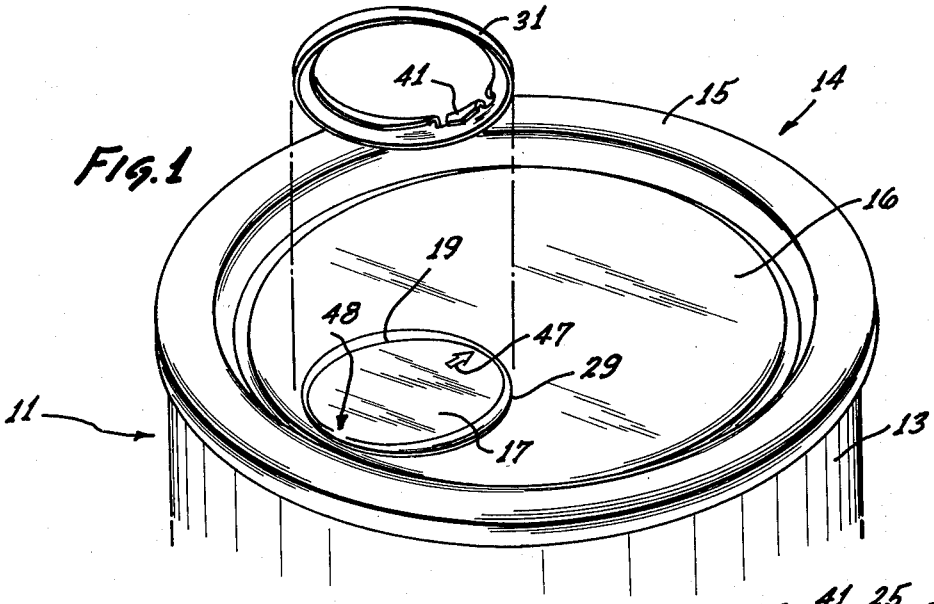
FIG. 1 is a fragmentary view in perspective of a preferred embodiment of an improved container employing the present invention, including a guard ring disassembled from an end wall of the container to show a panel in the end wall.
Figure 2:
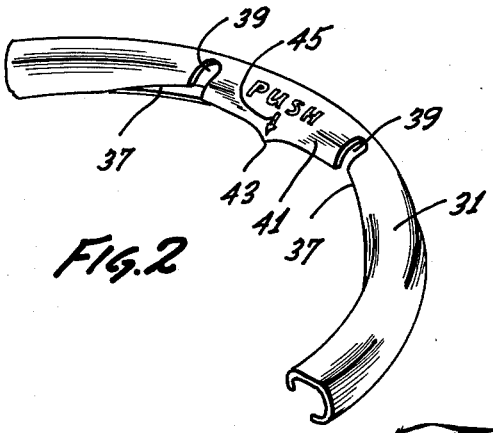
FIG. 2 is a fragmentary enlarged perspective view of the guard ring, showing a punch or push tab associated with the guard ring.

A container is illustrated in FIG. 1 and designated generally by the reference numeral 11. The container 11 is in the form of a can having a sidewall 13 and a top or end 14 fixed to the sidewall 13 in the usual manner. The top 14 includes an end wall 16 and a panel 17 defined in the end wall 16 by a score line 19. The score line 19 provides a line of weakness around the panel 17 which facilitates displacement of the panel 17 to form an opening into the container 11.

Figure 4:
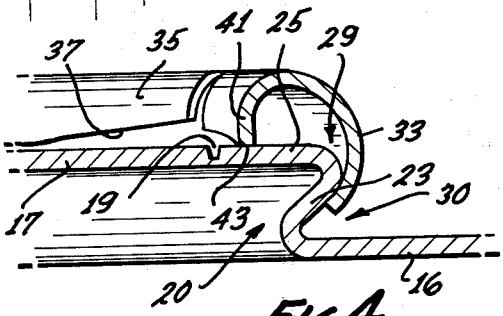
FIG. 4 is a fragmentary sectional view taken along line 4—4 of FIG. 3.

Both the end wall 16 and the panel 17 may have a generally planar configuration. In a preferred embodiment, the plane of the panel 17 is disposed outwardly of the container 11 in an elevated position with respect to the plane of the end wall 16. In other words, the plane of panel 17 may be substantially parallel to that of the end wall 16 at that location, realizing of course that the end wall may be domed, if desired. Disposed between the end wall 16 and the panel 17 are fold portions 20 including a first fold layer 23 connected to the end wall 16 and a second fold layer 15 interconnected between the first fold layer 23 and the panel 17. These fold layers 23 and 25 are best illustrated in FIG. 4. In this embodiment, the end wall 16 and the first fold layer 23 define an annular recess 30. In addition, the second fold layer 25 and the panel 17 each define one face of the score line 19.

The fold portion 20 also includes an annular shoulder 29 which is defined at the intersection of the first fold layer 23 and the second fold layer 25. In this embodiment, the shoulder 29 faces outwardly of the panel 17.

The shoulder 29 is particularly desirable for use in supporting a guard ring 31 which is illustrated in a disassembled relationship with the end wall 16 in FIG. 1. The guard ring 31 may include an annular flange 33 which extends into the recess 30 and over the shoulder 29. An annular lip 35 on the guard ring 31 is connected to the flange 33 and extends relative to the score line 19 in a manner to be discussed.

The lip 35 may be formed with a pair of slots 39 which define a resilient push tab or punch 41 integral with the ring 31 and having a pressure point 43 which extends downwardly toward the panel 17.

Although the slots 39 in the illustrated embodiment are generally perpendicular to the plane of the ring 31, this relationship is not critical. In general, it is merely desirable that the slots 39 be of sufficient length to provide the punch 41 with a high degree of flexure relative to the ring 31. In the preferred embodiment, the slots 39 extend not only through the lip 35 but also part of the way through the annular flange 33.

Figure 3:
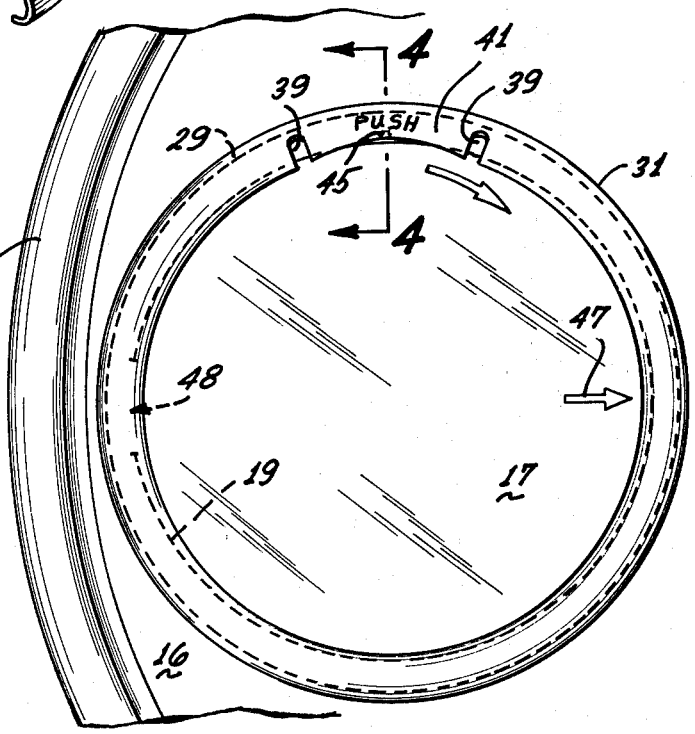
FIG. 3 is a fragmentary top plan view of the container showing the end wall and the guard ring positioned so that the punch has a nonrupturable relationship with the score line.
Figure 5:
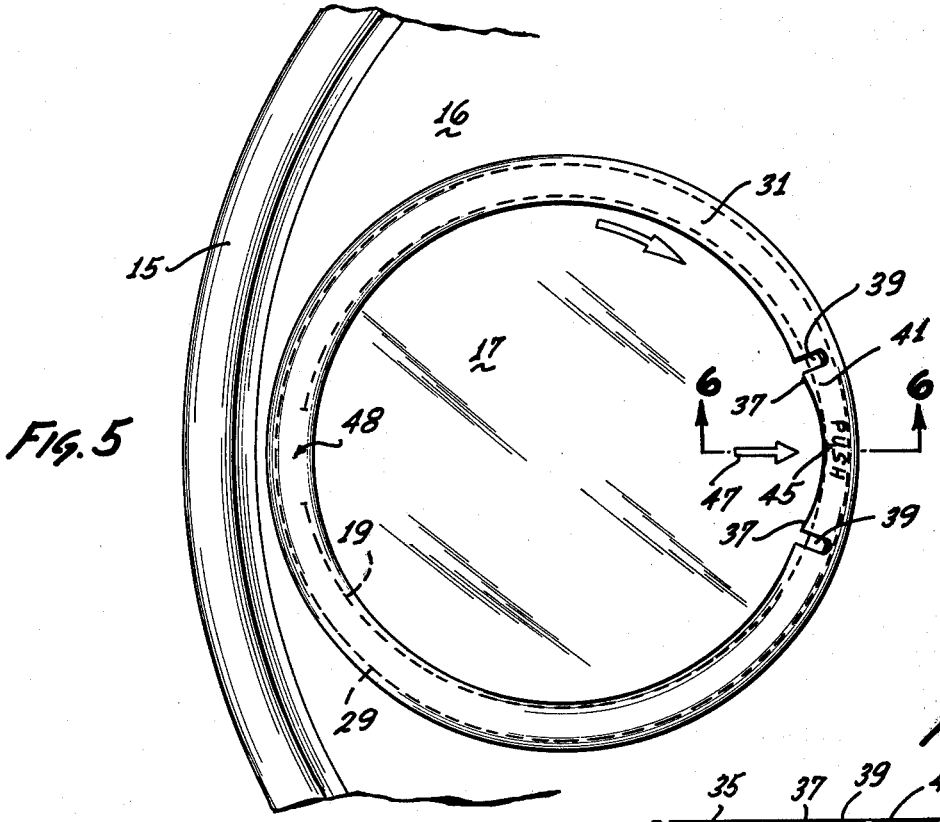
FIG. 5 is a fragmentary top plan view of the container showing the end wall and the guard ring positioned so that the punch has a rupturable relationship with the score line.

It may be desirable in an embodiment of the present invention that the guard ring 31 be rotatable on the shoulder 29 so that the punch 41 is movable between a first position illustrated in FIG. 3 and a second position illustrated in FIG. 5.

To facilitate disposition of the guard ring 31 in the second position, the punch 41 an be provided with indicia, such as an arrow 45 which aligns with indicia, such as an arrow 47, on the panel 17 when the ring 31 is in the second position. If the shoulder 29 is circular, as in the illustrated embodiment, the pressure point 43 preferably traverses a circular path concentric with the shoulder 29 between the first position and the second position.

If the pressure point 43 moves along a circular path concentric with the shoulder 29, it follows that the distance from the center of the circular path to the score line at the first and second positions must differ. It may also be desirable that the score line 19 be free of any sharp corners to facilitate tearing after the score line 19 has been initially ruptured. These characteristics of the score line 19 can be provided with a score line having the configuration of a circle which is nonconcentric with the shoulder 29 and the circular path of the pressure point 43. Thus the center of a circular score line could be displaced slightly from the center of the shoulder 29 in the direction of the arrow 47. Other shapes for the score line 19 will be apparent to those skilled in the art. For example, in the illustrated embodiment, the score line 19 has a configuration of an oval having its major axis extending generally between the arrow 47, where rupture of the score line first occurs, and a hinge 48 which supports the panel 17 when the latter is pushed into the container, as discussed below.

FIG. 4 provides a cross-sectional view through the punch 41 with the ring 31 in the first position. It will first be noted that in this embodiment the lip 35 including the punch 41 is of sufficient length to contact the second fold layer 25 and thereby support the ring 31 with the annular flange 33 in spaced relationship with the end wall 16. This relationship may be changed when the score line 19 is ruptured as discussed in greater detail below.

A relationship of particular interest to an embodiment of the present invention is associated with the disposition of the pressure point 43 with respect to the score line 19. It will be noted that in the first position of the ring 31, as illustrated in FIG. 4, the pressure point 43 has a distal relationship with the score line 19. With this distal relationship, a downward force on the punch 41 is less apt to rupture the score line 19 and thereby open the container 11. Thus, a rotatable ring 31, in the first position, is particularly advantageous for inhibiting the accidental opening of the container 11. This will be most appreciated during shipping when the containers 11 typically are stacked one upon the other so that stacking forces are exerted upon the ring 31.

Figure 6:
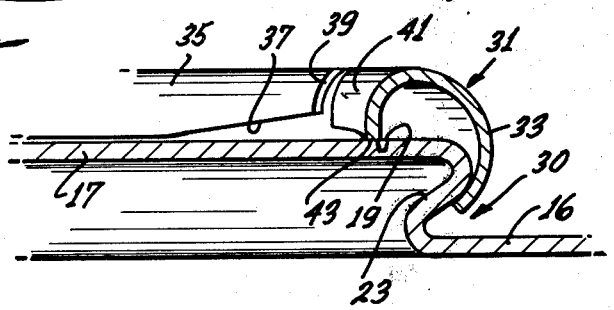
FIG. 6 is a cross-sectional view taken on line 6—6 of FIG. 5.

For comparison, one can refer to FIGS. 5 and 6 wherein the pressure point 43 is illustrated with the ring 31 in the second position. In this second position of the ring 31, the pressure point 43 of the resilient punch 41 is disposed in proximal relationship to the score line 19. In a preferred embodiment, the pressure point 43 is disposed just inwardly of the score line 19 so that it is in contiguous relationship with the panel 17.

Figure 7:
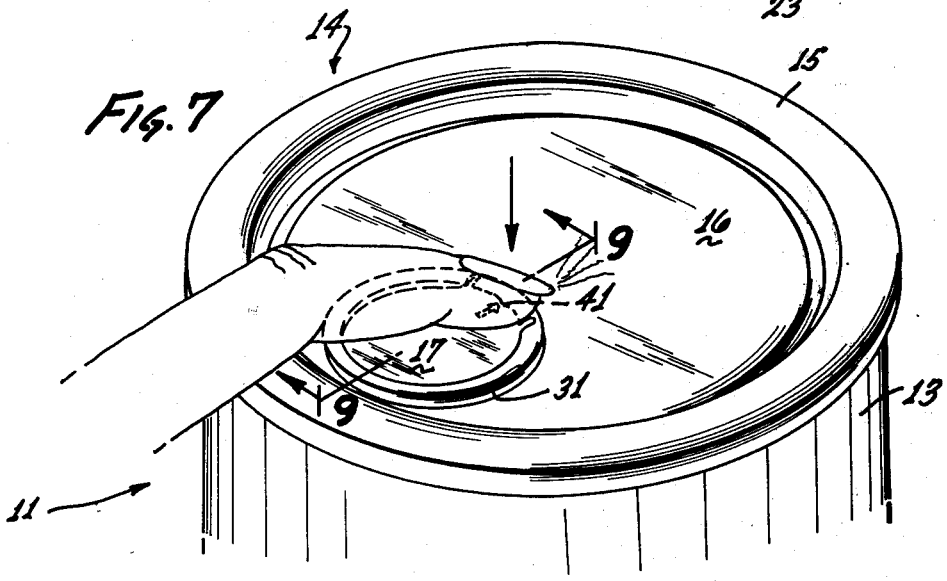
FIG. 7 is a perspective view showing a preferred method for rupturing the score line with finger pressure on the punch.
Figure 9:
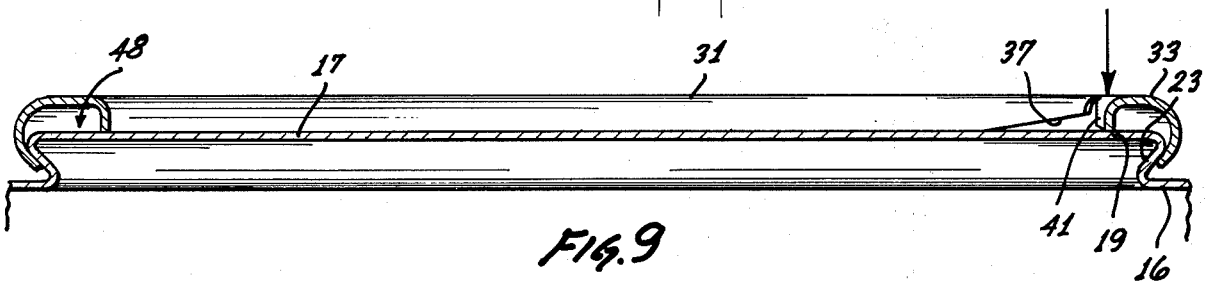
FIG. 9 is a radial cross-sectional view taken on lines 9—9 of FIG. 7 immediately prior to rupture of the score line.
Figure 10:
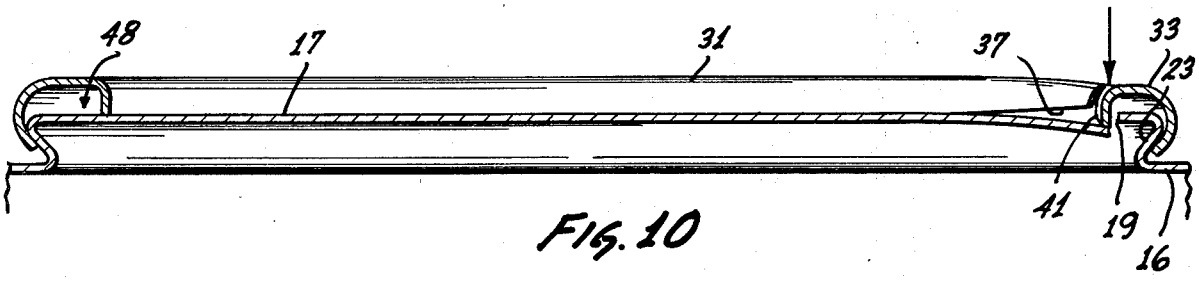
FIG. 10 is a cross-sectional view taken on lines 9—9 of FIG. 7 immediately following rupture of the score line.

With the pressure point 43 in this proximal relationship, a downward force on the punch 41 as shown in FIGS. 7 and 9 will rupture the score line 19 as shown in FIG. 10. The inclined portions 37 of the lip 35 facilitate the rupture of the score line 19 since they permit the entire ring 31, in proximity to the punch 41, to depress slightly as shown in FIG. 10. Thus the inclined portions 37 facilitate a greater downward travel of the punch 41 to provide a clean initial rupture of the score line 19.

Figure 8:
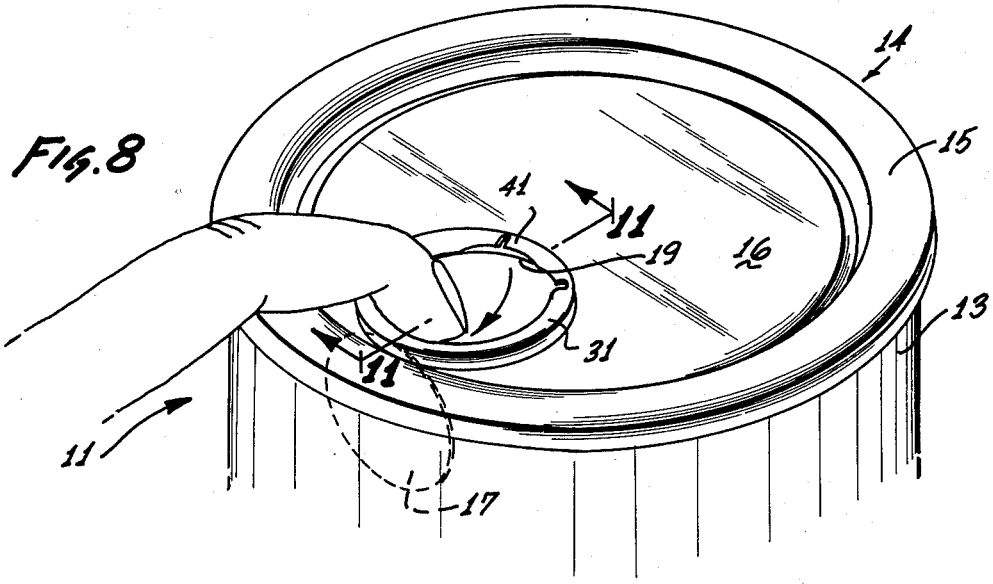
FIG. 8 is a perspective view of the panel being pressed into the container to open the container.

Once the score line 19 has been initially ruptured as illustrated in FIG. 10, a further pressure of the finger of the user downwardly on the panel 17 as illustrated in FIG. 8 will force the panel 17 into the container 11. Although the score line 19 may be continuous, it is noncontinuous in a preferred embodiment to form a hinge 48 between the second fold layer 25 and the panel 17 at a position diametrically opposite the arrow 47. In such an embodiment, the panel 17 pivots on the hinge 48 in response to the downward pressure of the user's finger. The downward displacement of the panel 17 is illustrated in perspective in FIG. 8 and in cross section in FIG. 11.

Figure 11:
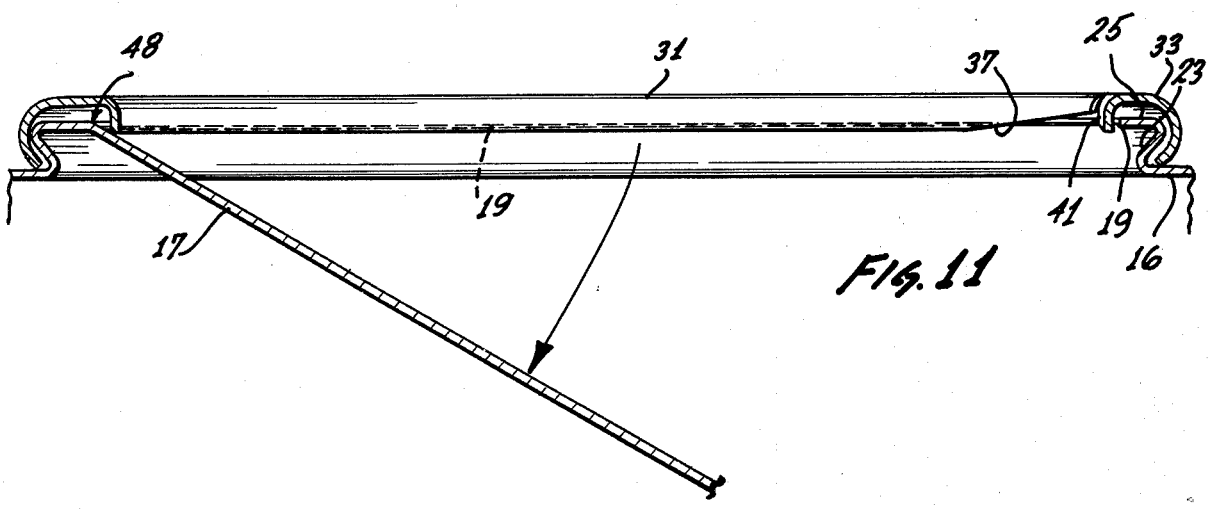
FIG. 11 is a cross-sectional view taken on lines 11—11 of FIG. 8.

The guard ring 31 is of further advantage as the finger of the user extends into the opening formed with the displacement of the panel 17. When the score line 19 is ruptured and torn it leaves a relatively sharp free edge around the second fold layer 25. In the past, when the user's finger has displaced a panel, it has moved into contact with this sharp edge and in many cases has become lacerated. This may be prevented in accordance with some embodiments of the present invention wherein the entire guard ring 31 may move downwardly slightly when the score line 19 is torn and the panel 17 is displaced as illustrated in FIG. 8. For example, the lip 35 of the ring 31, if disposed inwardly of the score line 19, may be free to fall into the opening, i.e., depending upon the score line configuration, so that it no longer supports the ring 31 with the flange 33 in spaced relationship with the end wall 16. Thus, once the score line 19 has been ruptured and torn, the ring 31 may be free to fall downwardly into the opening unit the ring 31 is supported by the flange 33 in contact with the end wall 16, as illustrated in FIG. 11. In this relationship with the end wall 16, the lip 35 of the ring 31 extends over the sharp free edge of the score line 19 to act as a shield for the finger of the user as the panel 17 is depressed.

It is particularly desirable that the guard ring 31 in the score-rupturing position be disposed with the push tab 41 positioned on the side of the panel 17 as far from the container wall as possible, as illustrated in FIG. 5. This disposition permits the user to reach across the panel 17 to apply the rupturing pressure to the punch 41 as illustrated in FIG. 7. Then, with a continuous downward pushing motion on the panel 17, the panel 17 can be displaced downwardly as it pivots on the hinge 48 as illustrated in FIG. 8.

It can be appreciated that the proximal relationship between the tab 41 and the score line 19 can be provided with the ring 31 in positions other than that illustrated. However, the continuous motion of the finger is desired so that the panel 17 will generally hinge on the side of the panel 17 opposite the punch 41.

In a further embodiment to the invention illustrated in FIGS. 12 to 16, elements which are similar to those of the previously described embodiment will be designated by the same reference numeral followed by the lower case letter *a*. For example, the end wall and panel are designated by the reference numerals 16*a* and 17*a* respectfully. In this particular embodiment, the plane of the panel 17*a* is disposed inwardly of, or below, the plane of the end wall 16*a*. The fold portion 20*a*, including a first fold layer 23*a* and a second fold layer 25*a*, extends between the end wall 16*a* and the panel 17*a*. In this particular embodiment, an annular shoulder 29*a* is defined between the first fold layer 23*a* and the end wall 16*a*. as opposed to the shoulder 29 in the previous embodiment, this shoulder 29*a* may face inwardly of the panel 17*a*. A score line 19*a* is defined between the panel 17*a* and the second portion 25*a* of the fold portion 20*a*. In this embodiment, it will be noted, the score line 19*a* may be located below the shoulder 29*a* to such an extent that the user may be protected from cutting himself on the ruptured score line, even if ring 31*a* should accidentally be detached from the shoulder.

As with the previous embodiment, a guard ring 31*a* may be provided for rotational movement, if desired, with respect to the shoulder 29*a*, from a first position wherein the rupturing of the score line 19*a* is inhibited to a second position where the rupturing of the score line 19*a* is facilitated. The first position of the ring 31*a* is illustrated in FIGS. 12 and 16, while the second position of the ring 31*a* is illustrated in FIGS. 13–15.

The guard ring 31*a* may include a first ring portion 51 having a diameter greater than that of the shoulder 29*a* and extending upwardly to a second ring portion 53 which extends radially inwardly from the first ring portion 51. A third ring portion 55 in this preferred embodiment may extend downwardly, as shown in FIG. 14, from the second ring portion 53, and have a diameter only slightly less than that of shoulder 29*a*. At the lowermost regions of the third ring portion 55, an annular flange 57 may curve around the shoulder 29*a*. This annular flange 57 may extend radially outwardly from the third ring portion 55, as illustrated. With this configuration, the annular flange 57 may thus have portions with a diameter greater than that of the shoulder 29*a* so that displacement of the ring 31*a* upwardly in FIG. 14 is inhibited by the shoulder 29*a*.

If desired, the annular flange 57 may be provided with an inclined portion 37*a* at the lower periphery thereof. This inclined portion 37*a* may terminate at a pair of slots 39*a* which define a resilient punch 41*a*, having a pressure point 43*a*. As illustrated, the slots 39*a* can be substantially perpendicular to the planes of the end wall 16*a* and the panel 17*a*.

When the ring 31*a* is disposed in the position illustrated in FIGS. 12 and 16, the pressure point 43*a* on the punch 41*a* is displaced from the score line 19*a*. The direction of this displacement is preferably outwardly of the score line 19*a* so that a downward pressure upon the punch 41*a* in the first position is not exerted upon the panel 17*a*. It follows that accidental forces, such as stacking forces, upon the punch 41*a* will not tend to rupture the score line 19*a* when the ring 31*a* is in the first position.

On the other hand, when ring 31*a* is located in the score-rupturing position (whether or not it is rotatable on the shoulder), as shown in FIG. 14, the score line 19*a* is preferably disposed slightly outwardly of that portion of the flange 57 on the punch 41*a*. Thus the pressure point 43*a* can be disposed over the panel 17*a* to extend at least partially over the score line 27*a*. With this relationship, the user can press upon the resilient punch 41*a* to exert a force upon the panel 17*a*, thereby tending to rupture the score line 19*a* as shown in FIG. 15.

In any of these embodiments, it may be desirable to provide the panel 17*a* with a stiffening bead 59 in proximity to the score line 19*a*. The stiffening bead 59 may extend around the entire panel 17*a* or it may be limited to a small area in proximity to the initial score-rupturing location as illustrated adjacent arrow 47*a* in FIG. 13. It is well known that such a bead 59 tends to stiffen the panel 17 to facilitate tearing of the score line 19 after it has been initially ruptured.

As previously noted, the selected relationship between the punch 41*a* and the score line 19*a* can be provided in many different ways. Perhaps the simplest way may be to provide the score line 19*a* with a non-concentric relationship with the annular shoulder 29*a*. Then, with the flange 57 moving in a circular path, punch 41*a* can cross over the score line 19*a* when ring 31*a* is rotated between the first and second positions. Of course the score line 19*a* could also have an oval or other non-circular configuration as previously described.

Prior to the rupturing of the score line 19*a*, and depending upon the configuration of the latter, the ring 31*a* may be supported in an elevated position due to the flange 57 resting on the second fold portions 25*a* (as illustrated in FIG. 16) or the panel 17*a* (as illustrated in FIG. 14). With the ring 31*a* in this elevated position, the first ring portions 51 are preferably spaced upwardly of the end wall 16*a*.

Once the score line 19*a* has been ruptured, the user can exert further pressure on the panel 17*a* to displace the panel 17*a* downwardly into the container 11*a*. When the panel 17*a* has been displaced to form an opening in the container 11*a*, the flange 57 may then be no longer supported by the panel 17*a* and the ring 31*a* may be free to be slightly lowered into the container 11*a*. The ring 31*a* will fall into the container 11*a* until the first ring portion 51 contacts the end wall 16*a*. With this contiguous relationship, the flange 57 preferably extends below the sharp free edge of the second fold layer 25*a* as illustrated in FIG. 15. Consequently, flange 57 will cover the relatively sharp free edge of the score face remaining along the edge of the second fold layer 25*a*. Thus, the ring 31*a* may provide means for guarding the user's finger against lacerations due to contact with this sharp free edge of the score line 19*a*.

The can end of the present invention as described with reference to these specific embodiments has significant advantages over the can ends of the prior art. The guard ring 31 in particular provides many advantages in its various positions. If the ring is rotatable as described in some of the embodiments, in the first position wherein the punch 41 is displaced from the score line 19, the ring 31 inhibits accidental rupture of the score line 19. This will be particularly appreciated when the containers 11 are stacked for shipping. Under these circumstances, prior art means for facilitating rupture of a score line 19 have also facilitated accidental rupture of the score line 19. However, with the guard ring 31 of the present invention, such accidental rupture is actually inhibited when the ring 31 is in the first position.

However, whether or not the ring is thus rotatable, the guard ring 31 is of special advantage when it is oriented in a score-rupturing position. The resiliently depressible punch facilitates initial rupturing of the score line 19 as not previously possible; this may be especially significant, for example, in the case of pressurized containers. With simple downward pressure on the punch, and a further downward pressure on the panel 17, an opening is formed which extends into the container 11. Once the opening is formed, those portions of the ring 31 which supported the ring 31 in an elevated position, may, in some embodiments, be permitted to fall into the opening to cover the relatively sharp free edge of the score line 19.

It will be apparent to those skilled in the art, from the foregoing illustrations and descriptions of various forms of the invention, that modifications may be made in the form, construction and arrangement of the parts without departing from the spirit and scope of the invention as defined in the following claims.

I claim:

1. An easy open end for a container comprising:

end wall means securable to the container for forming a closure for the container;

a panel included in the end wall means and being defined by a score line rupturable to form an opening in the end wall means;

means in the end wall means forming an annular shoulder and cooperating with the panel to support the panel in vertically spaced relationship with the end wall means;

means overlying said score line and movable on said annular shoulder between a first position and a second different poistion defining a score line rupturing punch which is inoperative to rupture the score line in said first position and being operative in said second position to effect rupture of the score line in response to downwardly applied pressure.

2. The easy open end recited in claim 1 wherein said means forming the annular shoulder comprises:

a first fold layer connected to the panel;

a second fold layer interconnected between said first fold layer and said end wall means; and said second fold layer cooperating with one of said first fold layer and said end wall means to form said annular shoulder.

3. The easy open end set forth in claim 1 wherein the rupturing of the score line produces a sharp free edge of the score line around the opening, and said movable means includes lip means movable through the opening with the forming of the opening to provide a guard ultimately disposed radially inwardly of the sharp free edge of the score line to guard the opening of the container.

4. An easy open end for a container and the like, comprising:

means forming an end wall securable to the container to form a closure for the container;

a panel included in said end wall and being defined by a rupturable score line to permit displacement of the panel relative to said end wall to form an opening in said end wall; and rupturing means mounted on said end wall and being movable relative to said end wall into a proximal position relative to said score line to overlie at least a portion thereof, said rupturing means being operable in the proximal relationship with said score line and in response to downward pressure to rupture the latter to facilitate displacement of the panel to open the container.

5. The easy open end set forth in claim 4 further comprising:

mounting means, included in said end wall and disposed between said panel and the remainder of said end wall, forming a shoulder having an annular configuration; and means, registering with said shoulder and movable relative to said end wall, for carrying said rupturing means between a distal position relative to said score line, and a proximal position relative to said score line wherein said rupturing means is operable to rupture said score line.

6. The easy open end set forth in claim 5 wherein said carrying means includes:

an annular flange, registering with said shoulder and rotatable thereon, and guard means cooperating with said annular flange and movable inwardly of a sharp free edge of score line when the latter is ruptured to define the opening of the container.

7. The easy open end set forth in claim 6 wherein said score line has a nonconcentric relationship with said annular shoulder.

8. The easy open end recited in claim 6 wherein said score line has a non-circular configuration.

9. An easy open end for a container comprising:

means forming an end wall adapted to be secured to a container to provide a closure for the container;

means defining a score line in said end wall, said score line at least partially circumscribing a panel in said end wall; and means mounted on said end wall forming a depressible pressure member for selective rupturing of said score line to permit displacement of said panel to form an opening into the container.

10. The easy open end set forth in claim 9 further comprising:

a fold portion included in said end wall and being disposed about said panel for supporting said panel at an elevation different than that of said end wall, said fold portion forming a shoulder having an annular configuration; and means rotatable on said shoulder for selectively moving said rupturing means into an initial score-rupturing relationship with said score line.

11. An easy open end for a container comprising:

means forming an end wall securable to the container to provide a closure for the container;

a first fold layer connected to said end wall;

a second fold layer connected to said first fold layer;

said first fold layer forming with one of said end wall and said second fold layer a shoulder having an annular configuration;

a panel connected to said second fold layer and being at least partly circumscribed by a score line;

an annular flange registerable with said annular shoulder and rotatable thereon;

a depressible member carried by said annular flange and movable with rotation of said annular flange between a first position wherein said depressible member is nonoperative to rupture said score line and a second position wherein said depressible member is depressible to rupture said score line and form an opening into the container, the rupturing of said score line creating a sharp free edge of the score line; and guard means connected to said annular flange and movable downwardly into the opening of the container to a position wherein said guard means is disposed inwardly of the sharp free edge of said score line to guard the opening of the container.

12. An easy open end for a container comprising:

means forming an end wall securable to the container to provide a closure for the container;

a first fold layer connected to said end wall;

a second fold layer connected to said first fold layer;

said first fold layer forming with one of said end wall and said second fold layer a shoulder having an annular configuration;

a panel connected to said second fold layer and being at least partly circumscribed by a score line;

an annular flange registered with said annular shoulder;

a depressible member carried by said annular flange and manually depressible from a first position wherein said depressible member is nonoperative to rupture said score line and a second position in which said depressible member ruptures said score line to form an opening into the container, the rupturing of said score line creating a sharp free edge of the score line; and guard means connected to said annular flange and movable downwardly into the opening of the container to a position wherein said guard means is disposed inwardly of the sharp free edge of said score line to guard the opening of the container.

13. An easy open end for a container comprising:

end wall means having a rupturable score line therein, a depressible panel at least partially defined by said score line, and means defining a shoulder for supporting said score line and said panel in a plane substantially parallel to that of said end wall and collar means mounted on said shoulder having guard means thereon operatively associated with said score line to act as a shield to inhibit contact with an edge of said score line when the latter is ruptured, punch means located thereon adjacent said score line and means intermediate said guard means and said punch means to provide for limited movement of the latter when actuated by a consumer to initiate rupturing of said score line.

14. The device of claim 13 wherein said collar means includes means for supporting said collar means so as to locate said guard means in a score line shielding position, below the level of the initial plane of said panel after said score line has been ruptured about a substantial portion thereof.

15. The device of claim 14 wherein said end wall means includes hinge means for said panel, defined by an interruption of said score line, to maintain attachment of said panel to said end wall.

16. The device of claim 13 wherein said score line is eccentrically located relative to the periphery of said shoulder and said collar means is rotatable about the axis of said shoulder from a position in which said punch means is relatively removed from said score line to a position in which said punch means is adjacent said score line and operatively located to initiate rupture thereof upon manual depression by a consumer.

* * * * *